US007258608B2

(12) United States Patent
Khal

(10) Patent No.: US 7,258,608 B2
(45) Date of Patent: Aug. 21, 2007

(54) KENO GAME WITH EXTRA CHANCES

(75) Inventor: Zaki Khal, Las Vegas, NV (US)

(73) Assignee: Las Vegas Gaming, Inc., Las Vegas, NV (US)

( * ) Notice: Subject to any disclaimer, the term of this patent is extended or adjusted under 35 U.S.C. 154(b) by 540 days.

(21) Appl. No.: 10/967,880

(22) Filed: Oct. 18, 2004

(65) Prior Publication Data

US 2006/0084490 A1 Apr. 20, 2006

(51) Int. Cl.
*A63F 3/06* (2006.01)
*A63F 3/08* (2006.01)

(52) U.S. Cl. ..... 463/18; 273/269; 463/17

(58) Field of Classification Search ..... 468/16–18, 468/25–28; 273/269, 138.1, 139, 274; 283/903
See application file for complete search history.

(56) References Cited

U.S. PATENT DOCUMENTS 5,269,523 A * 12/1993 Boylan et al. ..... 273/138.1
5,401,024 A 3/1995 Simunek
5,651,735 A 7/1997 Baba
5,909,875 A 6/1999 Weingardt
5,935,001 A 8/1999 Baba
6,102,400 A 8/2000 Scott et al.
6,315,290 B1 11/2001 Roethel et al.
6,364,313 B1 4/2002 Moody
6,368,213 B1 4/2002 McNabola
6,447,395 B1 9/2002 Stevens
6,478,677 B1 11/2002 Moody
6,506,118 B1 1/2003 Baerlocher et al.
6,605,002 B2 8/2003 Baerlocher
7,134,959 B2 * 11/2006 Penrice ..... 463/17
7,179,167 B2 * 2/2007 deKeller ..... 463/18
2001/0003098 A1 6/2001 Moody
2002/0025845 A1 2/2002 Cannon
2002/0063387 A1 * 5/2002 Timpano ..... 273/274
2004/0053668 A1 3/2004 Baerlocher

OTHER PUBLICATIONS

Keno Rules—http://www.onlinecasinoconditions.com/keno-rules.html Copyright 2005.*

* cited by examiner

*Primary Examiner*—Kenneth Bomberg
*Assistant Examiner*—Damon Pierce
(74) *Attorney, Agent, or Firm*—Kevin J Snyder; John V Stewart

(57) ABSTRACT

A method of playing Keno in which the quantity of numbers drawn is increased by including the integer above and/or below each number drawn, for at least some of the numbers drawn. This effectively increases the quantity of numbers drawn without requiring any additional steps by the players or modification of ball drawing equipment. For example, after drawing 20 numbers, the respective integer above each of the first 5 drawn numbers can be included in the draw. Optionally these extra numbers can be treated differently from those drawn, for example by applying to an additional bonus wager.

11 Claims, 1 Drawing Sheet

KENO GAME WITH EXTRA CHANCES

BACKGROUND OF THE INVENTION

1. Field of the Invention

This invention relates to Keno games, and especially to variations that provide extra chances of winning.

2. Description of Prior Art

Methods for increasing the number of hits per Keno game were described in the prior art sections of the patents below. These include playing multiple draws on the same ticket, "Four Card" Keno, and "Way Ticket" Keno. As stated in column 3 of U.S. Pat. No. 6,364,313: "The only limitation on the number of "ways" that a player may create on a Keno ticket is the imagination and creativity of the player as well as the player's bankroll." However, none of the described prior methods is the same as the present Keno method, and they do not suggest or imply it. The present method does not require additional "ways" of marking a ticket, nor does it require imagination and creativity of the players.

Playing multiple games on the same ticket requires multiple draws, which the present method does not. Other methods, such as "Four Card" Keno and "Way Ticket" Keno, require the player to select different sets of numbers for each of multiple games to be played on one draw. The present invention does not require either of these additional steps.

Another somewhat related game is a ticket drawing, such as at a party or dance, in which participants buy tickets. Stubs or duplicate tickets are shuffled and drawn. The matching ticket holder gets a percentage or all of the pot, depending on the game. Tickets may be sold in multiples, for example 5 tickets for a dollar, to give the illusion of an increased chance of winning. Since everyone buys the same multiples of tickets, the probability of winning on the first draw is the same as if the tickets were sold singly. However, if multiple draws are made on the remaining stubs for additional prizes, a player can win multiple times if multiple tickets are sold.

U.S. Pat. No. 6,315,290 (Roethel et al. Nov. 13, 2001) "Extra Ball Keno Game" discloses a method of playing Keno in two passes with a pool of 80 numbers. A player selects up to 10 numbers. Then there is a random draw of 20 numbers from the pool. A first quantity of hits is determined. If there are any hits, a second drawing equal to the amount of hits is taken from the remaining pool. These additional numbers are also matched to the original selection, and the player can be awarded based on the total hits, or the award can be based on the original hits plus a bonus for any additional hits. Roethel's method potentially increases the amount of numbers drawn, and thus increases the chance of hits, but it uses a different method that requires more steps than the present method.

U.S. Pat. No. 6,364,313 (Moody Apr. 2, 2002) "Multiple Play Keno Game with Bonus Feature" provides a Keno ticket having each "spot" divided into two or more sections, so the player can select two or more sets of numbers to be played in respective draws. This allows games to move faster by setting-up multiple games in advance on one ticket. Bonus hits may be offered by matching the draws with all the sets of numbers selected. This bonus feature increases the number of hits, but it requires both multiple set selections and multiple draws, so it adds complexity for the player that the present invention does not.

U.S. Pat. No. 5,651,735 (Baba Jul. 29, 1997) "Keno Machine with Two Separate Plays" provides a Keno game method having two passes. First, a standard Keno game is played on an interactive computerized display system. Secondly, if the number of hits in the first draw exceeds a given number, the system automatically randomly draws additional balls from the remaining pool of balls, and additional matches can be made. This is similar to the method of Roethel above. It uses a different method that requires more steps than the present invention.

U.S. Pat. No. 6,368,213 (McNabola Apr. 9, 2002) "Multi-Way Keno Method and Device" provides an interactive Keno display system capable of playing multi-way Keno. This display allows a player to select two or more subsets of numbers on a single Keno ticket to be compared to a set of randomly drawn numbers in addition to the superset of all numbers selected. For example, a player could select 2 numbers for the first "way", and 3 numbers for the second "way". In addition, all 5 numbers would be played as a third "way". Each "way" could potentially win. The payouts would be correspondingly low for a subset, and higher for the superset. This allows multiple games to be played on one draw, and provides both a higher chance of winning a low payout, with a lower chance of winning a high payout.

SUMMARY OF THE INVENTION

The objects of this invention include:

providing a method of playing Keno with increased chances of winning compared to conventional Keno;

without requiring additional steps by the player; and without requiring additional draws; and without requiring modification to existing ball-drawing equipment.

These objects are met in a method of playing Keno in which the quantity of numbers drawn is increased by including the integer above and/or below each number drawn, for at least some of the numbers drawn. This effectively increases the quantity of numbers drawn without requiring any additional steps by the players or modification of ball drawing or display equipment. For example, after drawing 20 numbers, the respective integer above each of the first 5 drawn numbers can be included in the draw. Optionally these extra numbers can be treated differently from those originally drawn, for example by offering an additional bonus wager. Simplicity is a substantial benefit in itself, making play easier and faster than the prior methods described above.

BRIEF DESCRIPTION OF THE DRAWINGS

Integers are part of the drawing itself, so all of the reference characters are letters to avoid confusion.

REFERENCE CHARACTERS

Figure 1:
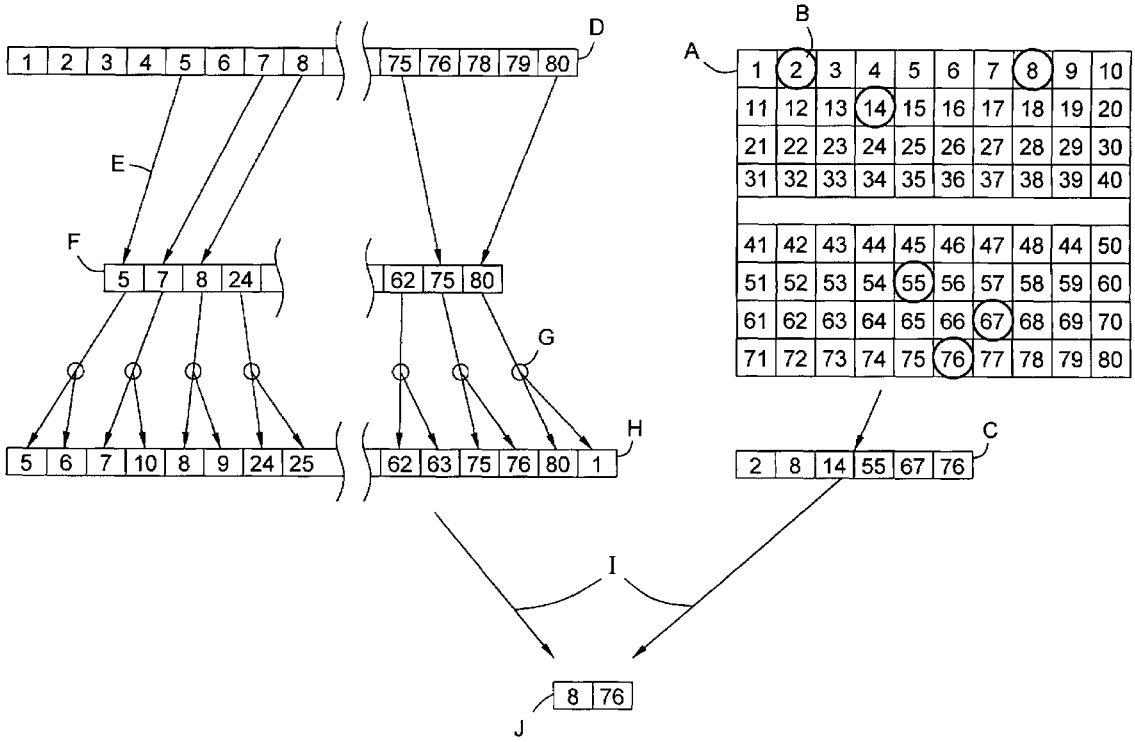
FIG. 1 is a schematic view of a Keno game played according to an embodiment of the present of the invention.

A. A game card or other display of available integers with means for a player to indicate selected integers;

B. A "spot" or integer selected by a player;

C. A set of integers selected by a player. This is the "first" subset of integers in the claims;

D. A range of integers for play. It may be represented by numbered balls or other display means;

E. A step of random selection or drawing of a number from the range of available integers;

F. The integers drawn. This is the "second" subset of integers in the claims;

G. Derivation step for extra numbers;

H. The union set of drawn integers and derived integers;

I. Comparison step;

J. Matches or hits. This is the intersection set of the player-selected integers C and the union set H of drawn integers and derived integers.

Terminology

Teaser number—an additional number that was not part of the actual draw in a random drawing of numbers for a game of chance. Teaser numbers are derived from drawn numbers according to rules for a particular game as described herein.

Operator—a person or system that performs random drawings and adds teaser numbers.

DETAILED DESCRIPTION

The invention is a method of playing Keno in which the quantity of numbers drawn is increased by including the integer above or below each number drawn, for at least some of the numbers drawn. This effectively increases the quantity of numbers drawn. For example, after drawing 20 numbers, the respective integer above each of the first 5 drawn numbers can be included as "teaser" numbers. Teaser numbers can be included in the main play, and/or can be used for an additional bonus wager.

The rules for deriving teaser numbers from drawn numbers should account for integer overlap or integer range overflow. If two adjacent integers are drawn, such as the numbers 5 and 6, then at least one of those is both a teaser number and a drawn number. In this example, if teaser numbers are to be derived as one above the drawn numbers, then teaser 6 overlaps drawn 6. In such a case, the next available integer can be added as a teaser number, so 7 can be substituted for 6 as the teaser number derived from 5. Another option is to use the nearest available integer. In the above example, the number 4 could be substituted for 6 as the teaser number derived from 5. If a teaser number exceeds the available range of integers, the range of integers can be treated as a circular list. For example, if the range of available integers is 1-80, and the number 80 is drawn, then the higher teaser number derived from 80 can be 1. Alternately to these adjustments, if an overlap or overflow occurs, the teaser number can be cancelled. Teaser numbers may be derived from some or all of the drawn integers. For example in a drawing of 20 numbers, the first 5 numbers drawn could produce teaser numbers.

An advantage of the present method over prior methods discussed in the prior art section above is simplicity. Standard Keno play methods and equipment can be used. The operator or an interactive computer system on which Keno is played simply adds the teaser numbers to the draw. This does not require additional plays, additional marks, additional draws, or new equipment, unlike the prior art above.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. In a game of chance based on randomly drawn numbers, a method of increasing the probability of winning, comprising the steps of:

a) providing a range of available integers for play;

b) selecting by choice a first subset of integers from the range of available integers;

c) randomly selecting a second subset of integers from the range of available integers;

d) deriving integers according to at least one method selected from the list of steps consisting of, d.1) selecting the next greater integer above each of at least some of the randomly selected integers and d.2) selecting the next lesser integer below each of at least some of the randomly selected integers; and e) calculating winnings based on matches between the first and second subsets and on matches between the first subset and the derived integers.

2. The method of claim 1 wherein the range of integers is treated as a circular list in the derivation steps d.1 and d.2, so that each derived integer is within the range of available integers.

3. The method of claim 2 wherein if a given derived integer matches one of the drawn integers, then the given derived integer is replaced with another available integer that is numerically close to the given derived integer.

4. A method of playing Keno with extra chances of winning, comprising the steps of:

a) providing a range of available integers for play;

b) a player choosing a first subset of integers from the available integers;

c) an operator randomly drawing a second subset of integers from the available integers;

d) the operator deriving a third subset of integers comprising the nearest available integer not drawn above each integer drawn for at least some of the integers drawn; and e) the operator calculating winnings based on matches between the first and second subsets and on matches between the first and third subsets.

5. The method of claim 4 wherein the range of available integers is treated as a circular list in derivation step d) so that each derived integer is within the range of available integers.

6. The method of claim 5, wherein if a given derived integer matches one of the drawn integers, then the given derived integer is ignored.

7. The method of claim 5 wherein if a given derived integer matches one of the drawn integers, then the given derived integer is replaced with the next higher available integer not drawn in the range of integers.

8. A method of playing Keno with extra chances of winning, comprising the steps of:

a) providing a range of available integers for play;

b) a player choosing a first subset of integers from the available integers;

c) an operator randomly drawing a second subset of integers from the range of available integers;

d) the operator deriving a third subset of integers comprising the nearest available integer not drawn below each integer drawn for at least some of the integers drawn; and e) the operator calculating winnings based on matches between the first and second subsets and on matches between the first and third subsets.

9. The method of claim 8 wherein the range of available integers is treated as a circular list in derivation step d) so that each derived integer is within the range of available integers.

10. The method of claim 9 wherein if a given derived integer matches one of the drawn integers, then the given derived integer is ignored.

11. The method of claim 9 wherein if a given derived integer matches one of the drawn integers, then the given derived integer is replaced with the next lower available integer not drawn in the range of integers.

* * * * *